United States Patent [19]

Tomono et al.

[11] 3,951,835

[45] Apr. 20, 1976

[54] TONER FOR DEVELOPING ELECTROSTATIC LATENT IMAGES CONTAINING AN ALKYLENE-BIS FATTY ACID AMIDE

[75] Inventors: Makoto Tomono; Noriyoshi Tarumi, both of Hachioji, Japan

[73] Assignee: Konishiroku Photo Industry Co., Ltd., Tokyo, Japan

[22] Filed: Feb. 7, 1974

[21] Appl. No.: 440,466

[30] Foreign Application Priority Data

Feb. 19, 1973 Japan ..... 48-19239

[52] U.S. Cl. ..... 252/62.1 R; 96/1 SD

[51] Int. Cl.[2] ..... G03G 9/00

[58] Field of Search ..... 96/1 SD; 252/62.1; 117/37.5

[56] References Cited

UNITED STATES PATENTS

| | | | |
|---|---|---|---|
| 3,529,983 | 9/1970 | Vasta | 252/62.1 |
| 3,669,922 | 6/1972 | Bartsch et al. | 96/1 SD |
| 3,826,747 | 7/1974 | Nagashima et al. | 252/62.1 |

*Primary Examiner*—David Klein
*Assistant Examiner*—John L. Goodrow
*Attorney, Agent, or Firm*—Jordan B. Bierman; Linda G. Bierman; Kenneth J. Stempler

[57] ABSTRACT

A toner for developing electrostatic latent images which comprises a colorant, a styrene type resin containing a styrene component in an amount of more than 25% by weight based on the sum of a resin component of the toner and an alkylene-bis fatty acid amide represented by the following general formula:

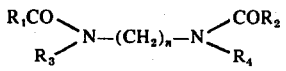

wherein $R_1$ and $R_2$ stand for saturated or unsaturated aliphatic hydrocarbon residues having at least 10 carbon atoms, $R_3$ and $R_4$ are a hydrocarbon atom or a group $—COR_5$ in which $R_5$ is a saturated or unsaturated aliphatic hydrocarbon residue, and $n$ is a positive integer.

4 Claims, No Drawings

TONER FOR DEVELOPING ELECTROSTATIC LATENT IMAGES CONTAINING AN ALKYLENE-BIS FATTY ACID AMIDE

This application claims the priority of Japanese Application 19239/73, filed Feb. 19, 1973.

This invention relates to a toner for developing electrostatic latent images in electrophotography, electrostatic recording, electrostatic printing and the like. The process for developing electrostatic latent image is devided roughly into a liquid developing process in which a liquid developer formed by finely dispersing a pigment or dye in an organic insulating liquid is employed and a so-called dry developing process in which a finely divided developer called toner, which is formed by dispersing a colorant such as carbon black into a natural or synthetic resin, is used. As the latter dry development process, there are mentioned the cascade method, the fur brush method, the magnetic brush method, the impression method and the powder cloud method. This invention relates to a toner to be used in the latter type dry developing process.

After an electrostatic latent images have been developed with use of a toner, fixation is conducted. In general, fixation is performed by fusing toner images obtained by development directly on a photoconductive photosensitive material or electrostatic recording material on which electrostatic latent images have been formed and retained, or by transferring a toner images obtained by development to a transfer sheet from a photoconductive photosensitive material or electrostatic recording material and fusing the transferred toner image on the transfer sheet. At this step, the fixation of the toner image is accomplished by contacting the toner image with a solvent vapor or heating the toner image. As the heating means there are adopted a non-contact heating method using an electric furnace and a contact heating method using a heated roller.

According to the contact heating method using a heated roller, fixation is accomplished by passing a sheet carrying unfixed toner images through the heated roller while contacting the toner image side surface of the sheet with the surface of the heated roller which is composed of a material having a releasing characteristics for the toner. This method is generally called the heated roller fixing method, and since the toner image side surface of the sheet is contacted under compression with the surface of a heated roller in this method, a very high heat efficiency can be attained on fixation of the toner image on the sheet and fixation can be accomplished promptly. Accordingly, this method is very effective when applied to an electrophotographic copying machine of the transfer type which is to conduct the copying operation at a high speed. In this method, however, since the toner image is contacted under compression with the surface of the heated roller, a toner is molten, so that a part of the toner image sticks to the surface of the roller and it is transferred again to a late running sheet to cause a so-called offset phenomenon. Therefore, the prevention of the offset phenomenon is one of the most indispensable requirements in the heated roller fixing method.

In order to prevent the offset phenomenon, it has heretofore been used a roller which is coated with a tetrafluoroethylene polymer or the like having releasing characteristics for the toner and apply a offset-preventive liquid such as silicone oil to the roller surface to form a liquid film on the surface. Although this method is very effective for preventing the offset phenomenon, a smell is generated by heating of the offset-preventing liquid and since a device should be additionally provided for feeding the offset-preventing liquid, the structure of the copying machine becomes complicated. Furthermore, since high precision is required for obtaining good results stably, the manufacturing cost of the copying machine is very high. However, since an undesired offset phenomenon is caused by sticking of the toner on the fixing roller surface if no offset-preventive liquid to the fixing roller surface.

It is a primary object of this invention to provide a toner for developing electrostatic latent images, with use of which the heated roller fixation can be performed in good conditions with very high efficiency without causing an offset phenomenon even when an offset-preventive liquid is not applied to the roller surface.

Another object of this invention is to provide a toner for developing electrostatic latent images, with use of which the heated roller fixation can be performed in good conditions without causing an offset phenomenon even when a metal roller which is generally regarded as having no releasing characteristics is employed as the heated roller.

We have found that the foregoing objects can be attained by a toner for developing electrostatically charged images which comprises a colorant, a styrene type resin which has a styrene component more than 25% by weight of a whole resin component in the toner and an alkylene-bis fatty acid amide represented by the following general formula:

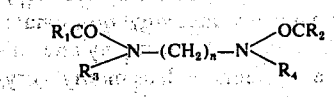

wherein $R_1$ and $R_2$ stand for a saturated or unsaturated aliphatic hydrocarbon residue having at least 10 carbon atoms, $R_3$ and $R_4$ indicate a hydrogen atom or a group $-OCR_5$ in which $R_5$ is a saturated or unsaturated hydrocarbon residue, and $n$ is a positive integer.

If a toner of this invention is employed for developing electrostatic latent images, even when no offset-preventing liquid is applied to a fixing roller or when a metal roller is used as the fixing roller, the heated roller fixation can be performed in good conditions with very high efficiency without causing an offset phenomenon. Therefore, by use of the toner of this invention, the mechanism of the fixing device can be simplified and precision, stability and reliability of a high speed copying machine can be highly improved. Furthermore, the manufacturing cost of such copying machine can be reduced and designing of a super high speed copying machine can be greatly facilitated. These are advantages attained by the toner of this invention.

A suitable pigment or dye is used as the colorant in the toner of this invention. For example, there are employed carbon black, Nigrosine dyes, Aniline Blue, Chalco Oil Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengale, and mixtures thereof. It is indispensable that such colorant is incorporated in the toner in an amount sufficient to form a visible image on development.

In the toner of this invention, a styrene type resin is used as the resin component. Either a homopolymer of styrene, a copolymer of styrene with other vinyl monomer or a blend of the homopolymer or copolymer with other resin can be used as the styrene type resin. As the monomer forming a copolymer with styrene, there can be mentioned, for example, β-chlorostyrene; vinyl naphtalene; unsaturated mono-olefins such as etylene, propylene, butylene and isobutylene; vinyl esters such as vinyl chloride, vinyl bromide, vinyl fluoride, vinyl acetate, vinyl propionate, vinyl benzoate and vinyl butyrate; esters of α-methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate, acrylonitirle, methacrylonitrile, acrylamide; vinyl ethers such as vinyl methyl ether, vinyl ethyl ether and vinyl isobutyl ether; vinyl ketones such as vinyl methyl ketone, vinyl hexyl ketone and methyl isopropenyl ketone; and N-vinyl compounds such as N-vinylpyrrole, N-vinylcarbazole, N-vinylindole and N-vinylpyrrolidone. One or more of these monomers can be copolymerized with styrene. A styrene type resin has a weight average molecular weight of at least about 3000, and it is preferred that the styrene content of the styrene type resin is at least about 25% by weight based on the total weight of the resin component in the toner.

A styrene type resin comprising a styrene resin and, incorporated therein, other resin can be used as the resin component of the toner of this invention. As the resin to be incorporated in the styrene resin, there can be mentioned, for example, homopolymers of vinyl naphthalene; vinyl esters such as vinyl chloride, vinyl bromide, vinyl fluoride, vinyl acetate, vinyl propionate, vinyl benzoate and vinyl butyrate; α-methylene aliphatic monocarboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate; acrylonitrile, methacrylonitrile; acrylamide; vinyl ethers such as vinyl methyl ether, vinyl isobutyl ether and vinyl ethyl ether; vinyl ketones such as vinyl methyl ketone, vinyl hexyl ketone and methyl isopropenyl ketone; and N-vinyl compounds such as N-vinylpyrrole, N-vinylcarbazole, N-vinylindole and N-vinylpyrrolidone; and compolymers formed by copolymerizing two or more of these monomers. In addition, non-vinyl thermoplastic resins such as rosin-modified phenol-formalin resins, oil-modified epoxy resins, polyurethane resins, cellulose resins and polyether resins can be used in combination with the styrene resin. When such resin is used in combination with a styrene resin, it is preferred that both the resins are mixed so that the amount of the styrene component is at least about 25% by weight based on the sum of the resin components. The releasing characteristic of the toner to a fixing roller is closely concerned with the amount present of the styrene component, and as the amount of the styrene component is reduced, the releasing characteristic of the toner tends to decrease. Therefore, it is preferred that the styrene resin is present in the above amount.

As the alkylene-bis fatty acid amide represented by the above general formula, the following compounds can be typically exemplified:

$C_{10}H_{21}CO—NH—(CH_2)_5—NH—OCC_{10}H_{21}$ 1.

$C_{11}H_{23}CO—NH—(CH_2)_4—NH—OCC_{11}H_{23}$ 2.

$C_{13}H_{27}CO—NH—(CH_2)_2—NH—OCC_{13}H_{27}$ 3.

$C_{10}H_{21}CO—NH—(CH_2)_3—NH—OCC_{14}H_{29}$ 4.

$C_{15}H_{31}CO—NH—(CH_2)_2—NH—OCC_{15}H_{31}$ 5.

$C_{17}H_{35}CO—NH—(CH_2)—NH—OCC_{15}H_{31}$ 6.

$C_{17}H_{35}CO—NH—(CH_2)_2—NH—OCC_{15}H_{31}$ 7.

$C_{23}H_{47}CO—NH—CH_2—NH—OCC_{15}H_{31}$ 8.

9) $(C_{11}H_{23}CO)_2N—(CH_2)_2—N(OCC_{11}H_{23})_2$

10) $(C_{17}H_{35}CO)(CH_3CO)N—CH_2—N(OCC_{17}H_{35})(CH_3CO)$

11) $(C_{13}H_{27}CO)(C_5H_{11}CO)N—(CH_2)_2—N(OCC_{17}H_{35})(OCC_5H_{11})$ $C_{21}H_{41}CO—NH—CH_2—NH—OCC_{21}H_{41}$ 12.

13) $(C_{17}H_{33}CO)(C_2H_5CO)N—(CH_2)_3—N(OCC_{17}H_{33})(OCC_2H_5)$ $C_{17}H_{35}CO—NH—(CH_2)_2—NH—OCC_{17}H_{31}$ 14.

15) $(C_{17}H_{35}CO)(C_{17}H_{35}CO)N—(CH_2)—NH—OCC_{17}H_{35}$

As commercially available alkylene-bis fatty acid amide compounds, there can be mentioned, for example, Bisamide (manufactured by Nitto Kagaku), Plastflow (manufactured by Nitto Kagaku), Diad 200 Bis (manufactured by Nippon Suiso), Rubron E (manufactured by Nippon Suiso), Arflow H 50 S (manufactured by Nippon Yushi) Arflow V-60 (manufactured by Nippon Yushi), Amide 6L (manufactured by Kawaken Fine Chemical), Amide 7S (manufactured by Kawaken Fine Chemical), Amide 6H (manufactured by Kawaken Fine Chemical), Armowax EBS (manufactured by Lion Armour), Hoechst Wax C (manufactured by Hoechst), Nopcowax 22DS (manufactured by Nopco Chemical), Advawax 280 (manufactured by Advance), Kaowax EB (manufactured by Kao Sekken) and Varisine 285 (manufactured by Baker Caster Oil).

Since the alkylene-bis fatty acid amide compound to be used as one component of the toner of this invention has a relatively large molecular weight, its softening point is high, and when an alkylene-bis fatty acid amide having a softening point falling within the softening temperature range of the resin component of the toner is employed, a good compatibility is attained between the alkylene-bis fatty acid amide and resin component and therefore, it is possible to make the alkylene-bis fatty acid amide present uniformly in individual toner particles, with the result that a toner having stable effects can be obtained. Further, since the alkylene-bis fatty acid amide to be used in this invention has a high decomposition-initiating temperature, it has a high thermal stability and its properties are not degraded even when the temperature is elevated at the kneading step of the toner preparation process.

In general, the softening point of the alkylene-bis fatty acid amide is higher as the number of carbon atoms of the aliphatic hydrocarbon residue is larger and the alkylene chain is longer. In view of the heating temperature adopted in preparing a toner and the heating temperature of a fixing roller used at the fixing step, alkylene-bis fatty acid amide compounds having a softening point of 100° to 180°C. are effectively employed. In view of the foregoing it is generally preferred that the length of the alkylene chain corresponds to a carbon atom number of 5 or less, though this preferred chain length varies to some extent depending on the kind of the aliphatic hydrocarbon residue.

The amount of the alkylene-bis fatty acid amide incorporated in the toner varies depending on the kinds and amounts of the resin component, colorant and additives of the toner, but it is generally within a range of 0.5 to 20 parts by weight, preferably 2 to 15 parts by weight, per 100 parts by weight of the resin component in the toner. The alkylene-bis fatty acid amide is added at the preliminary mixing of the resin component, colorant and various toner additives, which is conducted prior to the kneading step.

When the alkylene-bis fatty acid amide is present in toner particles, the flowability of the toner under heating and the releasing characteristic of the toner can be highly improved. Therefore, if a toner containing an alkylene-bis fatty acid amide is contacted under compression with a heated fixing roller, by virtue of the releasing action of the alkylene-bis fatty acid amide the fused toner can be prevented from sticking to the surface of the fixing roller and hence, no offset phenomenon is caused to occur. Further, since this compound improves the flowability of the resin component of the toner, good permeation of the toner into the surface of a fixing sheet can be attained, and hence, the compound also exhibits an effect of improving the fixing property of the toner.

This releasing effect can be attained not only in the case of a fixing roller having a surface composed of a releasing material but also in the case of a fixing roller having no releasing characteristic. A Teflon roller can be mentioned as a typical instance of the fixing roller having a surface composed of a releasing material and it is broadly used in the art. When the toner of this invention is employed it is made possible to employ a metal roller and because of an excellent heat conductivity of the metal roller the surface temperature can be reduced by about 30°C. as compared with the case of such Teflon roller, with the result that there is brought about an advantage that electric power consumption can be reduced. Thus, when the toner of this invention is used for development, occurrence of the offset phenomenon by the toner can be prevented even if a fixing roller having a surface composed of a material with no releasing characteristic is employed and great advantages are brought about in connection with the machine designing.

In addition to the above effects of improving the releasing and fixing properties of the toner, addition of the alkylene-bis fatty acid amide results in effects of the durability and quality of the developer by preventing agglomeration or cohesion of toner particles and improving the flowability of the toner and its mixing property with a carrier. These effects are especially conspicuous when the toner is positively charged. Moreover, the alkylene-bis fatty acid amide has an effect of improving the moisture resistance of the toner and stabilizing the properties of the developer. Furthermore, the alkylene-bis fatty acid amide improves the dispersibility of a colorant such as Nigrosine and other additives incorporated in the toner and uniformalizes the charge control in toner particles to thereby the properties of the developer.

The toner of this invention can comprise other various compounds having a releasing characteristic in combination with the above-mentioned alkylene-bis fatty acid amide compound. As such additional compound to be combined with the alkylene-bis fatty acid amide, there can be mentioned, for example, metal salts of fatty acids such as a cadmium, barium, lead, iron, nickel, cobalt, copper, strontium, calcium and magnesium salts of stearic acid; zinc, manganese, iron, cobalt, copper, lead and magnesium salts of oleic acid; zinc, cobalt, copper, magnesium, aluminum and calcium salts of palmitic acid; zinc, cobalt and calcium salts of linoleic acid; zinc and cadmium salts of ricinoleic acid and lead salts of caprylic and capronic acids; polyethylene and polypropylene having a relatively low molecular weight, higher fatty acids having at least 28 carbon atoms, and matural and synthetic paraffins. These compounds can be singly or the form of a mixture of two or more of them. Such compound is incorporated into the toner in an amount of 0.1 to 10 parts by weight, preferably 0.5 to 5 parts by weight, per 100 parts by weight of the resin component of the toner. By addition of such compound, the compatibility of the alkylene-bis fatty acid amide with the resin component is further improved and the dispersibility of the colorant, the material for control of trifoelectric property such as dye and other additives of the toner is similarly improved. Further, when the resin component is relatively brittle, excessive pulverization of toner particles at the pulverizing step of the toner preparation process can be prevented by addition of such compound, and the toner having a desired particle size can be obtained in a high yield. Still further, by virtue of the presence of such compound, the stability of the toner is further increased, and the trifoelectrical property of the toner is not changed even when it is used for a long time, so that the life of the toner can be greatly prolonged.

Various additives used in this field can be added to the toner of this invention according to need.

A toner image formed on a fixing sheet by employing the toner of this invention can be fixed by a heated roller at a high efficiency without causing the offset phenomenon even when no offset preventing liquid is fed to the fixing roller. As the fixing roller, there can be effectively employed a roller having a smooth surface formed of a fluorine resin such as Teflon (manufactured by Du Pont), Fluon (manufactured by ICI) ad Kel F (manufactured by 3M) or of a relatively rigid silicone rubber such as KE-1300 RTV (manufactured by Shinetsu Kagaku), and a roller having a metal surface. As the roller having a metal surface, a roller having a hard chromium treated surface is effectivel because of excellent toughness and mirror smoothness.

This invention will now be illustrated more detailedly by reference to Examples which by no means limit the scope of this invention. All of "parts" mentioned in these Examples are on the weight basis unless otherwise indicated.

EXAMPLE 1

100 parts of Piccolastic D-150 (styrene resin manufactured by Esso Petrochemical), 5 parts of Pearless 155 (manufactured by Columbia Carbon), 5 parts of Nigrosine Base EX (manufactured by Orient Kagaku)

and 10 parts of Plastflow (ethylene-bis-stearoamide manufactured by Nitto Kagaku) were mixed, treated in a ball mill for about 24 hours, kneaded by means of a hot roll, cooled and pulverized to form a sample toner having an average particle size of about 13 to about 15 microns. A comparative toner sample was similarly prepared without addition of Plastflow.

4 parts each of these samples were individually mixed with 96 parts of an iron powder carrier having an average particle size of about 50 to about 80 microns to obtain two developers. With use of these developers, electrophotographic method were developed, toner images were transferred onto transfer sheets, and the surfaces of the transfer sheets were contacted under compression with a fixing roller having a surface composed of FEP (tetrafluoroethylene-hexaluoropropylene copolymer manufactured by Du Pont) at a temperature of 200° to 210°C. to fuse the toner images and fix them on the sheets. After the fixation treatment, in order to examine whether the offset phenomenon would occur or not, a transfer sheet having no toner image was contacted with the fixing roller under the same conditions as above and it was examined whether contamination was brought about or not on the transfer sheet by the offset phenomenon of the toner.

As a result it was confirmed that in the case of the comparative toner sample contamination was extreme by the offset phenomenon of the toner but in the case of the sample according to this invention no contamination was brought about. Thus, it was confirmed that in the case of the toner sample according to this invention no offset phenomenon was caused to occur. Even when the fixation treatment was conducted repeatedly, the same results were obtained.

When a transfer sheet having images formed by the toner sample according to this invention was contacted under compression at 165° to 175°C. with a fixing metal roller having a hard chromium treated surface to fix the toner image, no contamination owing to the offset phenomenon was observed.

EXAMPLE 2

80 parts of Piccolastic E-125 (styrene resin manufactured by Esso Petrochemical), 20 parts of Eslec BL-S (polyvinyl butyral resin manufactured by Sekisui Kagaku), 10 parts of Pearless 155, 3 parts of Oil Black BW (manufactured by Orient Kagaku) and 10 parts of Bisamide (methylene-bis-stearoamide manufactured by Nitto Kagaku) were mixed and treated in the same manner as in Example 1 to obtain a toner sample. Separately, a comparative sample was similarly prepared without addition of Bisamide.

With use of each of these samples, the fixation of a toner was carried out in the same manner as in Example 1 except that a fixing roller having a surface composed of Teflon (polytetrafluoroetylene manufactured by Du Pont) was employed and the fusing temperature was changed to 170° to 180°C., and occurrence of the offset phenomenon of the toner was examined with respect to each sample. As a result it was confirmed that in the case of the comparative sample occurrence of the offset phenomenon of the toner was extreme but in the case of the sample according to this invention no offset phenomenon was caused to occur.

A transfer paper having an image of the toner sample according to this invention was contacted under compression at 145° to 155°C. with a fixing metal roller having a hard chromium treated surface to fuse the toner image and fix it, and this fixing treatment was repeated. No contamination owing to the offset phenomenon was observed in transfer sheets.

EXAMPLE 3

100 parts of a copolymer composed of about 80 parts of styrene and about 20 parts of dimethylaminoethyl methacrylate, 5 parts of Dia Black SH (manufactured by Mitsubishi Kasei) and 5 parts of Hoechst Wax C (ethylene-bis-stearoamide manufactured by Hoechst) were mixed and treated in the same manner as in Example 1 to form a toner sample. Separately, a comparative sample was prepared in the same manner without addition of Hoechst Wax C.

With use of each of these toner samples, the fixation of the toner was carried out in the same manner as in Example 1 except that a fixing roller coated with KE-1300 RTV (silicon rubber manufactured by Shinetsu Kagaku) was employed and the fusing temperature was changed to 180° to 190°C., and occurrence of the offset phenomenon was examined with respect to each sample.

As a result it was confirmed that in the case of the comparative sample occurrence of the offset phenomenon the toner was conspicuous but in the case of the toner sample according to this invention no offset phenomenon of the toner was caused to occur.

EXAMPLE 4

100 parts of a copolymer composed of about 70 parts of styrene and about 30 parts of 3-chloro-2-hydroxypropyl methacrylate, 8 parts of Dia Black SH, 5 parts of Oil Black BW and 7 parts of Plastflow were mixed and treated in the same manner as in Example 1 to form a toner sample.

Separately, a comparative toner sample was similarly prepared without addition of plastflow.

With use of these toner samples, the fixation of the toner was carried out in the same manner as in Example 1 except that a fixing roller having a surface composed of Teflon was employed and the fusing temperature was changed to 180° to 190°C., and occurrence of the offset phenomenon of the toner was examined with respect to each sample.

As a result it was confirmed that in the case of the comparative toner sample occurrence of the offset phenomenon of the toner was extreme but in the case of the toner sample according to this invention no offset phenomenon was caused to occur.

EXAMPLE 5

100 parts of a copolymer composed of about 85 parts of styrene and about 15 parts of stearyl methacrylate, 5 parts of Pearless 155, 5 parts of Nigrosine Base EX and 10 parts of Hoechst Wax C were mixed and treated in the same manner as in Example 1 to form a toner sample.

Separately, a comparative toner sample was prepared without addition of Hoechst Wax C.

With use of these two samples, the fixing treatment was carried out in the same manner as in Example 1 except that a fixing roller having a surface composed of Teflon was employed and the fusing temperature was changed to 190° to 200°C., and occurrence of the offset phenomenon of the toner was examined with respect to each sample. As a result it was confirmed that in the case of the comparative sample occurrence of the offset phenomenon of the toner was conspicuous but in the case of the toner sample according to this invention no offset phenomenon was caused to occur.

Further, the fixation of the toner was carried out in the same manner as in Example 1 by employing a metal roller having a hard chromium treated surface and a fusing temperature ranging from 160° to 170°C., and occurrence of the offset phenomenon was examined. It was confirmed that in the case of the toner sample according to this invention no offset phenomenon was caused to occur.

EXAMPLE 6

100 parts of Piccolastic D-150, 5 parts of Dia Black SH, 5 parts of Nigrosine Base EX (manufactured by Orient Kagaku), 5 parts of Plastflow and Sazol Wax HI (high-melting-point synthetic paraffin manufactured by Sazol Marcketing) were mixed and treated in the same manner as in Example 1 to obtain a toner sample. Separately, a comparative sample A was prepared in the same manner without addition of Sazol Wax HI and a comparative sample B was prepared in the same manner without addition of either Sazol Wax HI or Plastflow.

With use of these three samples, the fixation of the toner was carried out in the same manner as in Example 1 and occurrence of the offset phenomenon of the toner was examined with respect to each sample. As a result, it was confirmed that in the case of the comparative sample B occurrence of the offset phenomenon of the toner was conspicuous but in the case of either the comparative sample A or the sample according to this invention, no offset phenomenon was caused to occur. When the fixation of the toner was carried out repeatedly, it was confirmed that in the case of the sample according to this invention the trifoclectric characteristic was not changed for a longer time than in the case of the comparative sample A and the toner life was longer in the case of the toner sample according to this invention. At the pulverizing step of the toner preparation process, it was found that excessive pulverization was hardly caused in the case of the sample according to this invention as compared with the comparative Sample A.

EXAMPLE 7

100 parts of a copolymer composed of about 65 parts of styrene and about 35 parts of butyl methacrylate, 8 parts of Dia Black SH, 3 parts of Nigrosine Base EX, 5 parts of Bisamide and 2 parts of AC Polyethylene 6A (low-molecular-weight polyethylene manufactured by Allied Chemical) were mixed and treated in the same manner as in Example 1 to form a toner sample. Separately, a comparative sample A was similarly prepared without addition of AC polyethylene 6A and a comparative sample B was similarly prepared without addition of either AC Polyethylene 6A or Bisamide.

With use of these three toner samples, the fixation of the toner was carried out in the same manner as in Example 1 except that a fixing roller having a surface composed of Teflon was employed, and occurrence of the offset phenomenon was examined with respet to each sample.

As a result it was confirmed that in the case of the comparative sample B occurrence of the offset phenomenon was conspicuous but in the case of either the comparative sample A or the sample according to this invention no offset phenomenon was caused to occur. As a result of the repeated treatment test, it was confirmed that in the case of the sample according to this invention the triboelectric characteristic was not changed for a longer time that in the case of the comparative sample A and the sample according to this invention had a longer life.

EXAMPLE 8

100 parts of a copolymer composed of about 50 parts of styrene, about 30 parts of butyl methacrylate and about 20 parts of methyl methacrylate, 5 parts of Pearless 155, 5 parts of Nigrosine Base, 8 parts of Hoechst Wax C and 3 parts of barium stearate were mixed and treated in the same manner as in Example 1 to form a toner sample. Separately, a comparative sample A was prepared in the same manner without addition of barium stearate and a comparative same B was prepared in the same manner without addition of either barium stearate or Hoechst Wax C.

With use of these three toners, the fixation of the toner was carried out in the same manner as in Example 1 except that the fusing temperature was changed to 180° to 190°C., and occurrence of the offset phenomenon was examined with respect to each sample. As a result it was confirmed that in the case of the sample B occurrence of the offset phenomenon was conspicuous but in the case of either the comparative sample A or the sample according to this invention no offset phenomenon was caused to occur.

As a result of the repeated treatment test, it was found that in the case of the sample according to this invention the triboelectric characteristic was not changed for a longer time than in the case of the comparative sample A and the sample according to this ivnention had a longer life.

EXAMPLE 9

80 parts of a copolymer composed of about 80 parts of styrene and 20 parts of ethyl methacrylate, 20 parts of vinylite VYLF (copolymer of about 87 parts of vinyl chloride and about 13 parts of vinyl acetate manufactured by Bakelite Exylonite), 8 parts of Dia Black SH, 5 parts of Nigrosine Base EX, 3 parts of Bisamide and 2 parts of Hoechst Wax PA 190 (low-molecular-weight polyethylene manufactured by Hoechst) were mixed and treated in the same manner as in Example 1 to form a toner sample. Separately, a comparative sample was similarly prepared without addition of Bisamide.

With use of these two toner samples, the fixation of the toner was carried out in the same manner as in Example 1 except that the fusing temperature was changed to 190° to 200°C., and occurrence of the offset phenomenon of the toner was examined with respect to each sample. As a result it was confirmed that in the case of the comparative sample occurrence of the offset phenomenon was conspicuous but in the case of the sample according to this invention no offset phenomenon was caused to occur.

EXAMPLE 10

A toner sample was prepared in the same manner as in Example 1 except that the amount of Plastflow was changed from 10 parts to 5 parts and 3 parts of zinc stearate was further added. Separately, a comparative sample A was prepared in the same manner without addition of zinc stearate and a comparative sample B was prepared in the same manner without addition of either zinc strearate or Plastflow.

ith use of these three toner samples, the fixation of toner was carried out in the same manner as in mple 1 except that a fixing roller having a surface posed of KE-12 RTV (silicone rubber manufac- d by Shietsu Kagaku) was employed and the fusing perature was changed to 180° to 190°C., and occur- e of the offset phenomenon was examined wirh ect to each sample. As a result it was confirmed in the case of the comparative sample B occur- e of the offset phenomenon was conspicuous but in case of either the comparative sample A or the ple according to this invention no offset phenome- was caused to occur.

t the pulverizing step of the toner preparation pro-, in the case of the sample according to this inven- excessive pulverization was hardly caused to occur ompared with the case of the comparative sample

EXAMPLE 11

) parts of a copolymer composed of about 80 parts tyrene and about 20 parts of ethyl methacrylate, 20 ts of Vinylite VYLF, 8 parts of Dia Black SH, 5 ts of Nigrosine Base EX, 3 parts of Bismide, 2 parts Hoechst Wax PA 190 and 3 parts of Hoechst Wax S gher fatty acid manufactured by Hoechst) were ed and treated in the same manner as in Example 1 orm a sample toner. Separately, a comparative sam- was similarly prepared without addition of Bisa- le.

Vith use of these toner samples, the fixation of the er was carried out in the same manner as in Exam- 1 except that the fusing temperature was changed 155° to 165°C., and occurrence of the offset phe- nenon was confirmed that in the case of the compar- e sample the offset phenomenon was slightly caused occur but the offset phenomenon was not at all ised to occur in the case of the sample according to invention.

EXAMPLE 12

0 parts of a copolymer composed of about 80 parts styrene and about 20 parts of etyl methacrylate, 20 ts of Vinylite VYLF, 8 parts of Dia Black SH, 5 ts of Nigrosine Base EX, 3 parts of Hoechst Wax C, parts of Hoechst Wax PA 190, 3 parts of Hoechst ax S and 1 part of calcium palmitate were mixed and ated in the same manner as in Example 1 to form a er sample.

Separately, a comparative sample was similarly prepared without addition of Hoechst Wax C.

With use of these two samples, the fixation of the toner was carried out in the same manner as in Example 1 except that a fixing roller having a surface composed of KE-12 RTV was employed and the fusing temperature was changed to 160° to 170°C., and occurrence of the offset phenomenon was examined with respect to each sample.

As a result it was confirmed that in the case of the comparative sample the offset phenomenon was slightly caused to occur but in the case of the sample according to this invention the offset phenomenon was not at all caused to occur. As a result of the repeated treatment test it was found that in the case of the sample according to this invention the triboelectric characteristic was not changed for a long time and the sample toner had a long life.

What is claimed is:

1. A toner for developing electrostatic latent images which comprises a colorant, a styrene type resin containing a styrene component in an amount of more than 25% by weight based on the sum of a resin component of the toner and an alkylene-bis fatty acid amide represented by the following general formula:

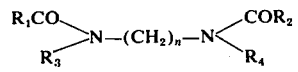

wherein $R_1$ and $R_2$ stand for saturated or unsaturated aliphatic hydrocarbon residues having at least 10 carbon atoms, $R_3$ and $R_4$ are a hydrogen atom or a group $-COR_5$ in which $R_5$ is a saturated or unsaturated aliphatic hydrocarbon residue, and $n$ is a positive integer.

2. A toner for developing electrostatic latent images according to claim 1, which further comprises a compound selected from a metal salt of fatty acid, polyethylene, polypropylene, higher fatty acid having more than 28 carbon atoms, and natural or synthetic paraffin.

3. A toner for developing electrostatic latent images according to claim 1 wherein said alkylene-bis fatty acid amide has a softening temperature of 100° to 180°C.

4. A toner for developing electrostatic latent images according to claim 1 wherein said alkylene-bis fatty acid amide is incorporated in an amount of 0.5 to 20 parts per 100 parts by weight of said styrene type resin.

* * * * *